US005669049A

United States Patent [19]

Palumbo et al.

[11] Patent Number: 5,669,049

[45] Date of Patent: Sep. 16, 1997

[54] MULTI-ROLL DEVELOPER HOUSING WITH CONVERGING BELT TO ROLL SPACING

[75] Inventors: Kenneth S. Palumbo, Irondequoit; Patricia J. Donaldson, Pittsford, both of N.Y.

[73] Assignee: Xerox Corporation, Stamford, Conn.

[21] Appl. No.: 573,687

[22] Filed: Dec. 18, 1995

[51] Int. Cl.[6] ..... G03G 15/08

[52] U.S. Cl. ..... 399/265; 399/223

[58] Field of Search ..... 355/245, 259, 355/260, 326 R, 327, 328; 399/222, 223, 265, 279, 286

[56] References Cited

U.S. PATENT DOCUMENTS

| | | | |
|---|---|---|---|
| 4,078,929 | 3/1978 | Gundlach | 96/1.2 |
| 4,847,655 | 7/1989 | Parker et al. . | |
| 5,010,368 | 4/1991 | O'Brien . | |
| 5,032,872 | 7/1991 | Folkins et al. . | |
| 5,080,988 | 1/1992 | Germain et al. . | |
| 5,208,636 | 5/1993 | Rees et al. . | |
| 5,241,359 | 8/1993 | Williams . | |
| 5,391,455 | 2/1995 | Bigelow . | |
| 5,416,567 | 5/1995 | Toyoshima et al. . | |
| 5,475,477 | 12/1995 | Tanuma et al. . | |

*Primary Examiner*—Sandra L. Brase
*Attorney, Agent, or Firm*—Lloyd F. Bean, II

[57] ABSTRACT

An electrophotographic printing machine, wherein an electrostatic latent image recorded on a photoconductive member is developed with toner to form a visible image thereof, wherein the improvement includes an apparatus for alleviating toner contamination of the electrophotographic printing machine while maintaining high quality visible images. The apparatus includes a first housing defining a chamber storing a supply of toner of a first color; the first housing including a first toner donor member spaced a first predetermined spacing from the surface and being adapted to transport toner of the first color to a region opposed from the surface, and a second toner donor member spaced a second predetermined spacing from the surface and being adapted to transport toner of the first color to the region opposed from the surface; and wherein the first predetermined spacing is substantially greater than the second predetermined spacing.

12 Claims, 4 Drawing Sheets

MULTI-ROLL DEVELOPER HOUSING WITH CONVERGING BELT TO ROLL SPACING

BACKGROUND OF THE INVENTION

This invention relates generally to a highlight color imaging and more particularly to a multi-roll developer housing with converging belt to roll spacing.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, the image area contains three voltage levels which correspond to two image areas and to a background voltage area. One of the image areas corresponds to non-discharged (i.e. charged areas) of the photoreceptor while the other image areas correspond to discharged areas of the photoreceptor. The charge areas are developed using Charged Area Development (CAD) while the discharged areas are developed using Discharged Area Development (DAD).

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge.

As will be appreciated, the quality of the prints produced through the use of a magnetic brush development process are dependent on the spacing of the development roll (BRS) or rolls from the photoreceptor. Generally, an electric field is established between those rolls and a supporting substrate for the photoreceptor to suppress background development. Thus, any change in the development roll spacing not only alters the quantity of toner deposited on the image, but also varies the gradient field. It goes without saying that changes in either of those two parameters are necessarily accompanied by corresponding changes in the quality of the prints produced. In addition to print quality issues in respect to the spacing of the development rolls from the photoreceptor, it has been found by the Applicants that machine problems occur which are also affected by the spacing of the development rolls from the photoreceptor, such as developer housing cross-contamination, electrostatic voltmeter (ESV) contamination and other machine dirt related problems.

Therefore, it is highly desirable to determine the optimum development roll-to-photoreceptor spacing which will alleviate the machine problems while maintaining high quality copies.

BRIEF SUMMARY OF THE INVENTION

Briefly, the present invention obviates the problems noted above by utilizing an apparatus for developing a latent image recorded on a surface moving in a predetermine path, including a first housing defining a chamber storing a supply of toner of a first color; the first housing including a first toner donor member spaced a first predetermined spacing from the surface and being adapted to transport toner of the first color to a region opposed from the surface, and a second toner donor member spaced a second predetermined spacing from the surface and being adapted to transport toner of the first color to the region opposed from the surface; and wherein the first predetermined spacing is substantially greater than the second predetermined spacing.

There is provided an electrophotographic printing machine, wherein an electrostatic latent image recorded on a photoconductive member is developed with toner to form a visible image thereof, wherein the improvement includes an apparatus for alleviating toner contamination of the electrophotographic printing machine while maintaining high quality visible images. The apparatus includes a first housing defining a chamber storing a supply of toner of a first color; the first housing including a first toner donor member spaced a first predetermined spacing from the surface and being adapted to transport toner of the first color to a region opposed from the surface, and a second toner donor member spaced a second predetermined spacing from the surface and being adapted to transport toner of the first color to the region opposed from the surface; and wherein the first predetermined spacing is substantially greater than the second predetermined spacing.

DETAILED DESCRIPTION OF THE PREFERRED EMBODIMENT OF THE INVENTION

Figure 1:
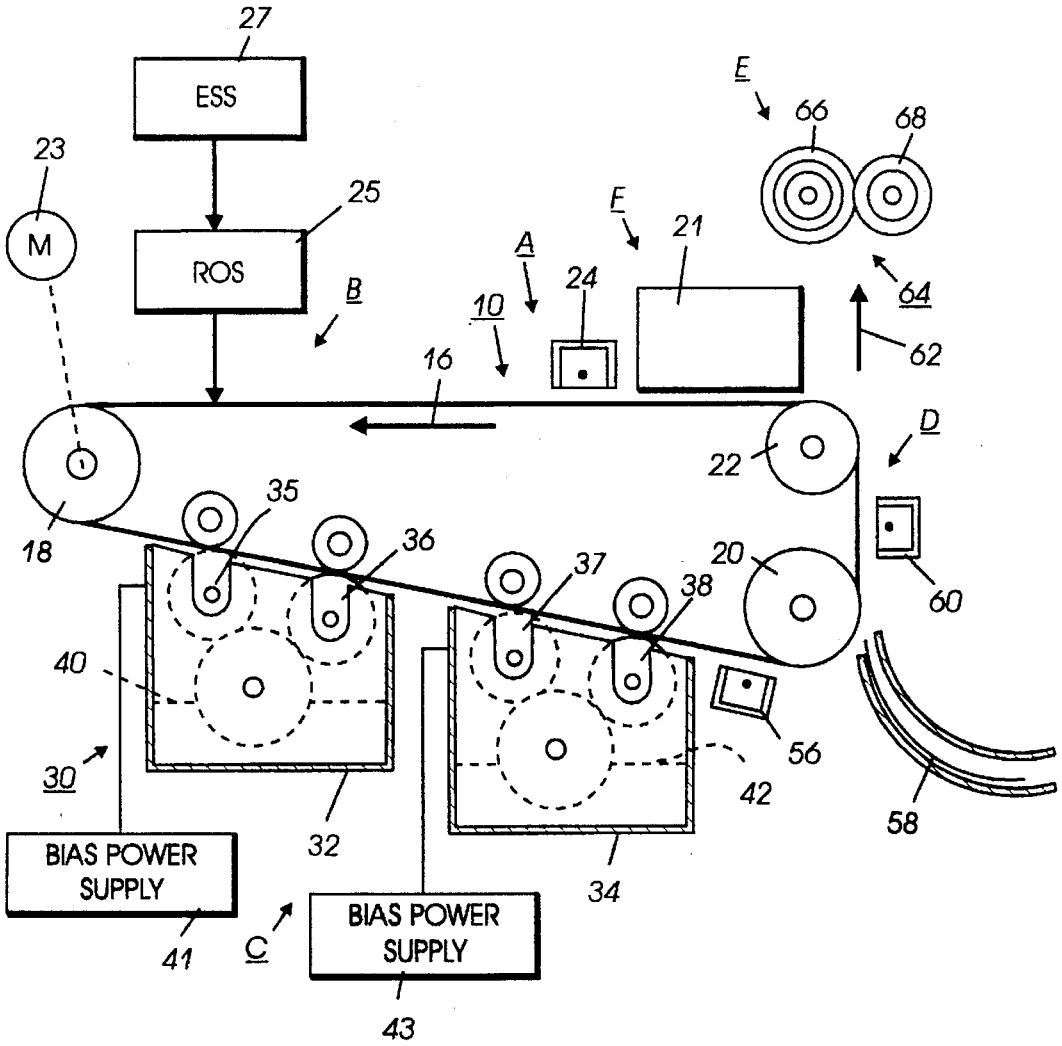
FIG. 1 is schematic illustration of a printing apparatus incorporating the inventive features of the invention.

As shown in FIG. 1, a printing machine incorporating the invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, VV0. Any suitable control, well known in the art, may be employed for controlling the corona discharge device 24.

Next, the charged uniformly portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a two level laser Raster Output Scanner (ROS).

During the imaging process two images are sequentially created on successive portions of the photoreceptor 10. A first image is represented by charged and discharged areas, the former being image areas and the latter being background areas on the photoreceptor. A second image is represented by charged and discharged areas, the former being background areas and the latter being image areas. The two images are subsequently developed by charged area development (CAD) and discharged area development (DAD) and sequentially transferred to a final substrate such as plain paper. Thus, for each image formed on the final substrate there are two images formed on the photoreceptor which are then transferred to the substrate.

The photoreceptor, which is initially charged to a voltage VV0, undergoes dark decay to a level VVCAD equal to about −750 volts. When exposed at the exposure station B the image areas remain at −750 volts while the background areas are discharged to a background voltage (VVbkg=a negative 100 volts). This results in the formation of the first image. For the second image, the photoreceptor is discharged to a voltage level VVDAD equal to about −100 volts in the image areas while the background areas, VVbkg remain at −750 volts.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the charged areas of the first image The developer material 40 by way of example contains positively charged black toner. Electrical biasing is accomplished via power supply 41 electrically connected to developer apparatus 32. A DC bias of approximately −150 to −200 volts is applied to the rollers 35 and 36 via the power supply 41 when the first image passes through the development zone between the development apparatus 32 and the photoreceptor. When the second image passes through this development zone the bias on the development apparatus 32 is switched to a voltage level of −800 to −850 volts to thereby preclude development of that image.

However, before reaching the developer apparatus 34, the photoconductive belt 10 passes subjacent to a voltage monitor, preferably an electrostatic voltmeter 33, for measurement of the voltage potential at the surface of the photoconductive belt 10. The electrostatic voltmeter 33 can be any suitable type known in the art wherein the charge on the photoconductive surface of the belt 10 is sensed, such as disclosed in U.S. Pat. Nos. 3,870,968; 4,205,257; or 4,853,639, the contents of which are incorporated by reference herein.

Figure 2:
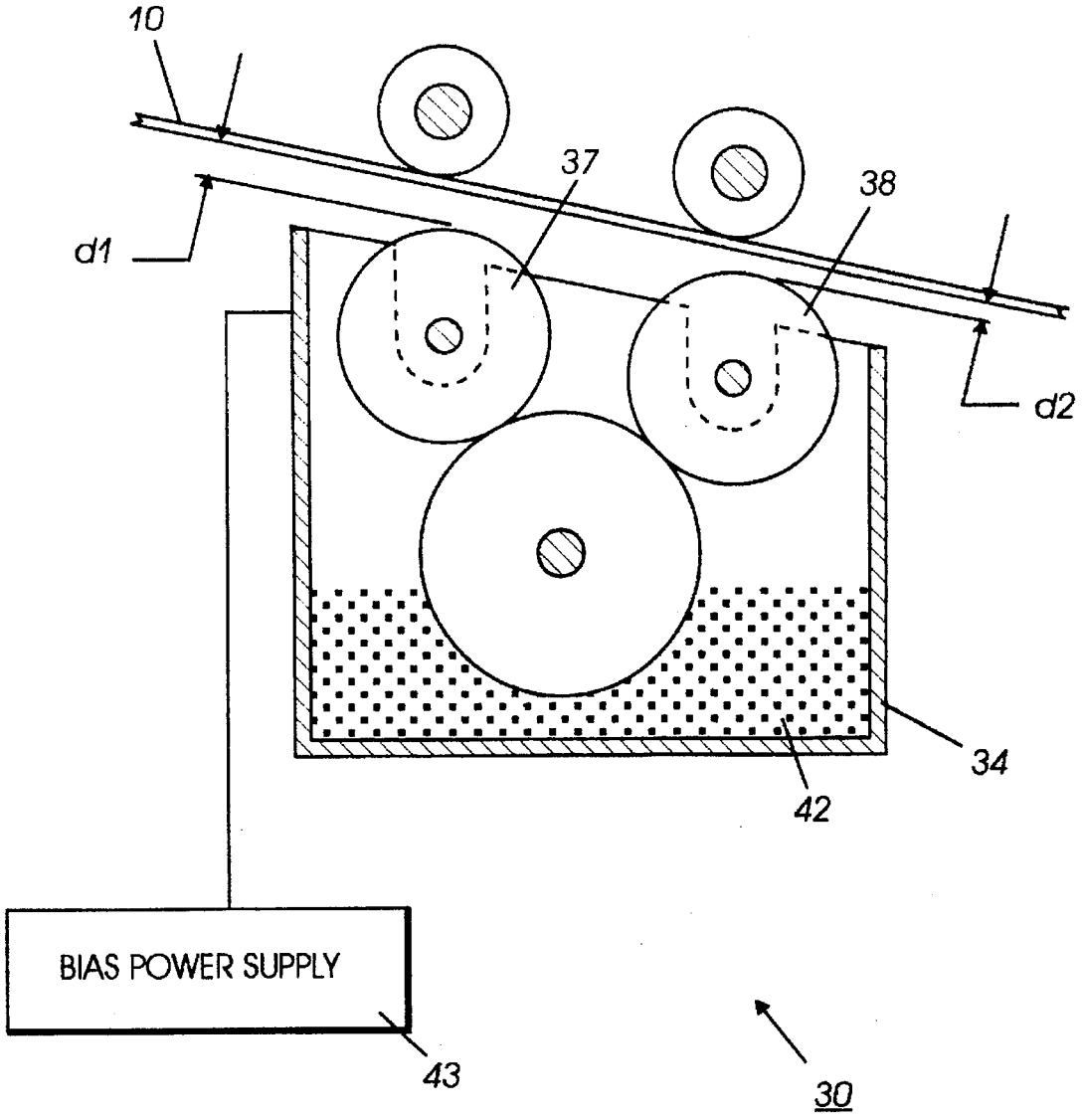
FIG. 2 is an enlarged schematic illustration of a developer apparatus 34 of FIG. 1 incorporating the inventive features of the invention.

A typical electrostatic voltmeter is controlled by a switching arrangement which provides the measuring condition in which charge is induced on a probe electrode corresponding to the sensed voltage level of a control patch on the belt 10. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit. The voltage potential measurement of the photoconductive belt 10 is utilized to determine specific parameters for maintaining a predetermined potential on the photoreceptor surface Referring to FIGS. 1 and 2, the developer apparatus 34 comprises a housing containing a pair of magnetic brush rolls 37 and 38 in which roll 37 has a greater BRS than roll 38. Preferably, the BRS of roll 37 ranges between 0.065" and 0.075" and preferrably having a mean of 0.070" with a standard deviation of 0.0017". The BRS of roll 38 ranges between 0.060" and 0.070" and preferrably having a mean of 0.065" with a standard deviation of 0.0017". The rollers advance developer material 42 into contact with the photoreceptor for developing the discharged-area images of the second image. The developer material 42 by way of example contains negatively charged red toner for developing the discharged-area images. Appropriate electrical biasing is accomplished via power supply 43 electrically connected to developer apparatus 34. A suitable DC bias of approximately −650 to −700 volts is applied to the rollers 37 and 38 via the bias power supply 43 when the second image passes through the development zone between the development apparatus 34 and the photoreceptor. When the first image passes this development zone the bias on the development apparatus 34 is switched to −0 to −50 volts to thereby preclude development of that image.

Referring back again to FIG. 1, a sheet of support material 58 is moved into contact with the toner images at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

At the transfer station, two images are sequentially transferred to a support sheet 58 to form the final image. Any suitable transfer device 64 is used for effecting sequential transfer of the images to the support sheet 58. The transfer device 64 causes the support to contact the photoreceptor.

After transfer, the sheet continues to move, in the direction of arrow 66, onto a conveyor (not shown) which advances the sheet to fusing station E. Fusing station E includes a fuser assembly, indicated generally by the reference numeral 68, which permanently affixes the transferred powder images to a copy substrate 60. Preferably, fuser assembly 68 comprises a heated fuser roller 70 and a backup roller 72. Sheet 60 passes between fuser roller 70 and backup roller 72 with the toner powder image contacting fuser roller 70. In this manner, the toner powder images are permanently affixed to sheet 60. After fusing, a chute, not shown, guides the advancing sheet 60 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush. Other cleaners such as a fur brush are also contemplated.

Subsequent to cleaning, a discharge lamp (not shown) floods the photoconductive surface with light to dissipate any residual electrostatic charge remaining prior to the charging thereof for the successive imaging cycle.

Figure 3:
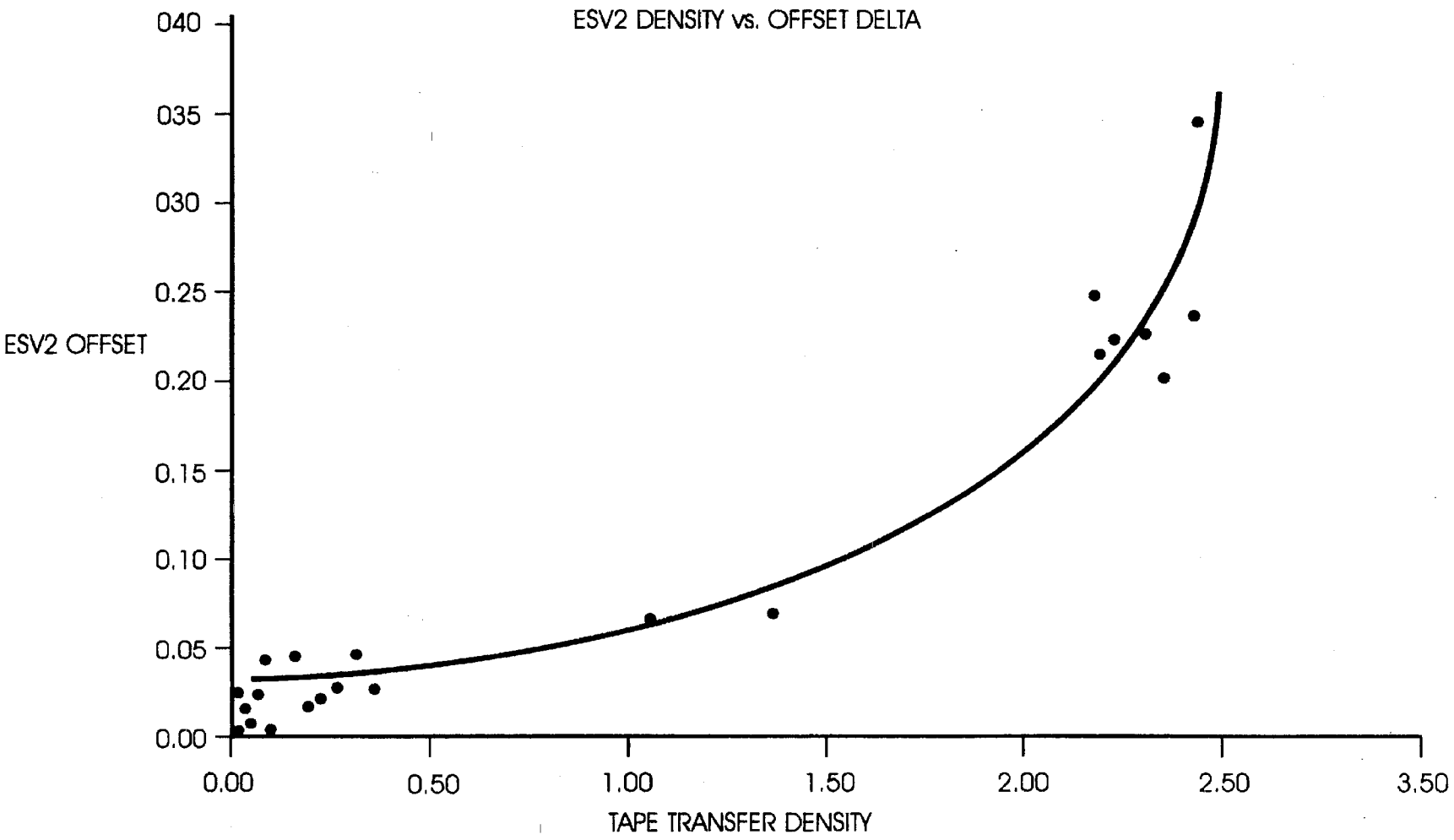
FIG. 3 is a graph illustrating electrostatic voltage reading versus dirt build up.
Figure 4:
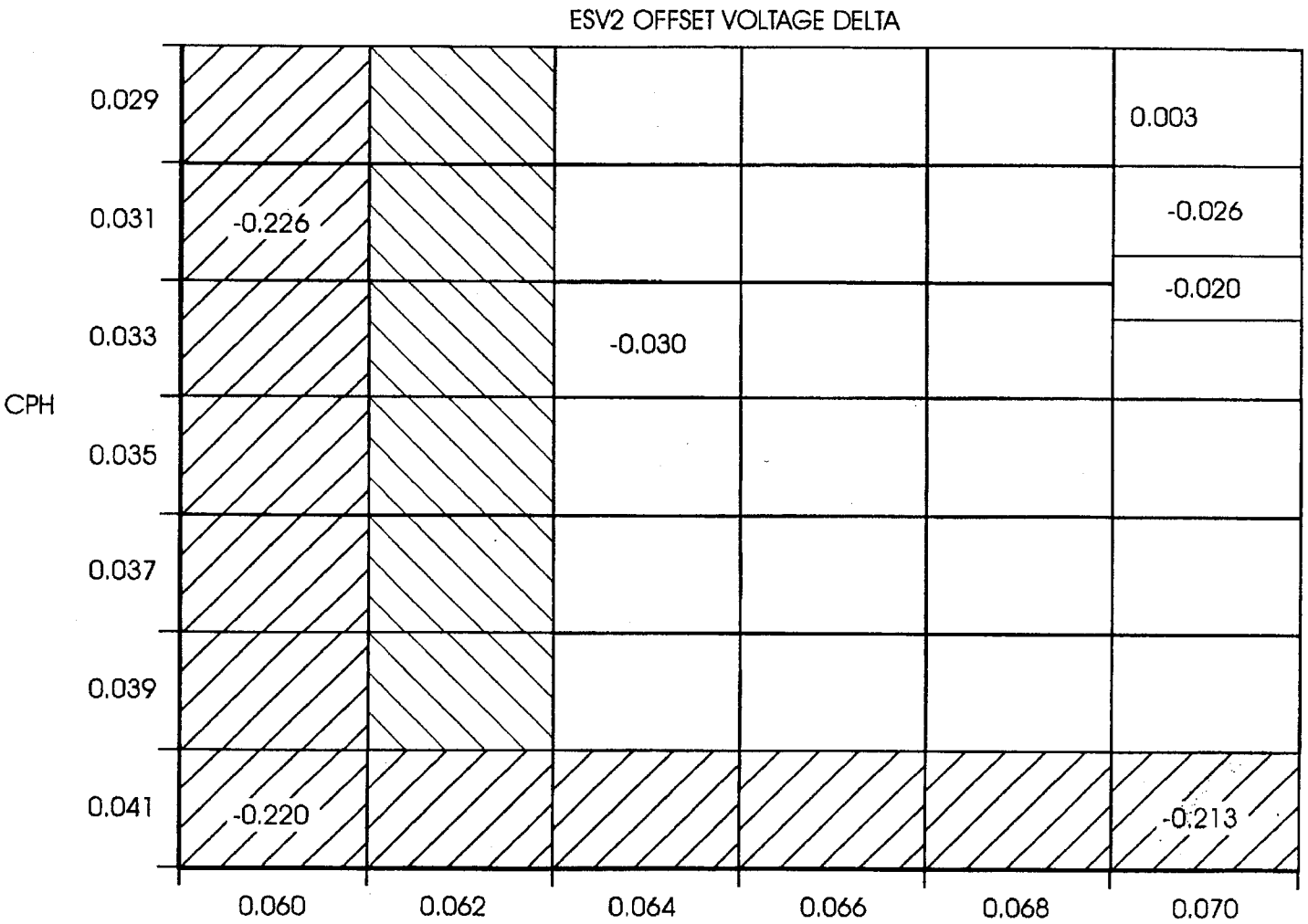
FIG. 4 is a graph illustrating BRS versus ESV contamination.

Referring to FIGS. 3 and 4, a machine in accordance of FIG. 1 was tested in which roll 37 has a greater BRS than roll 38. It was found that print quality was maintained, while machine problems which are also affected by the spacing of the development rolls from the photoreceptor, such as developer housing cross-contamination, electrostatic voltmeter contamination and other machine dirt related problems were obviated.

FIG. 3 shows that errors in electrostatic voltage readings are highly correlated with dirt building up on the ESV. The density of dirt was measured by transferring toner from the ESV to a blank sheet of paper using adhesive tape and measured with densitometer.

FIG. 4 illustrates the effect of variations in CPH (Compressed Pile Height) and BRS (Belt-to-Roll Spacing) on ESV (electrostatic voltmeter) contamination. In the right hand cross hatched regions of the Figure the errors in voltmeter readings would generally require a service call with adjustment or replacement of the ESV. In the left handed cross hatched regions the voltmeter errors would cause some print quality degradation and customer dissatisfaction. In the blank areas the voltmeters are reading correctly. The ration of CPH/BRS is commonly referred to as "packing factor" or pf. From this figure it is clear that decreasing packing factor will decrease ESV errors.

It has also been found that if the packing factor of both rolls are reduce simultaneously the reduction has a negative affect on solid area graniness of the image. However, it has been found that decreasing the packing factor on roll 38 while leaving roll 37 at a nominal value resulted in no degradation of solid area graininess while substantially reducing ESV contamination.

While the invention has been described with reference to specific embodiments, it will be apparent to those skilled in the art that many alternatives, modifications, and variations may be made. Accordingly, it is intended to embrace all such alternatives, modifications, and variations that may fall within the appended claims.

What is claimed is:

1. An apparatus for developing a latent image recorded on a surface moving in a predetermine path, comprising:

a first housing defining a chamber storing a supply of toner of a first color, said first housing including a first toner donor member spaced a first predetermined spacing immediately adjacent from the surface and being adapted to transport toner of said first color to a region opposed from the surface, and a second toner donor member spaced a second predetermined spacing immediately adjacent from the surface and being adapted to transport toner of said first color to the region opposed from the surface; and wherein said first predetermined spacing is substantially greater than said second predetermined spacing.

2. The apparatus of claim 1, further comprising a second housing adjacent to said first housing along said predetermine path, said second housing being adapted to transport toner of a second color to said region opposed from the photoconductive member before said first housing transport toner of said first color to the region.

3. The apparatus of claim 1, wherein said first predetermined spacing ranges from 0.065" to 0.075".

4. The apparatus of claim 3, wherein said first predetermined spacing has a mean of 0.070" with a standard deviation of 0.0017".

5. The apparatus of claim 3, wherein said second predetermined spacing ranges from 0.060" to 0.070".

6. The apparatus of claim 5, wherein said second predetermined spacing has a mean of 0.070" with a standard deviation of 0.0017".

7. An electrophotographic printing machine, wherein an electrostatic latent image recorded on a photoconductive member is developed with toner to form a visible image thereof, including an apparatus for alleviating toner contamination of the electrophotographic printing machine while maintaining high quality visible images, the apparatus comprising:

a first housing defining a chamber storing a supply of toner of a first color, said first housing including a first toner donor member spaced a first predetermined spacing immediately adjacent from the surface and being adapted to transport toner of said first color to a region opposed from the surface, and a second toner donor member spaced a second predetermined spacing immediately adjacent from the surface and being adapted to transport toner of said first color to the region opposed from the surface; and wherein said first predetermined spacing is substantially greater than said second predetermined spacing.

8. The apparatus of claim 7, further comprising a second housing adjacent to said first housing along said predetermine path, said second housing being adapted to transport toner of a second color to said region opposed from the photoconductive member before said first housing transport toner of said first color to the region.

9. The apparatus of claim 7, wherein said first predetermined spacing ranges from 0.065" to 0.075".

10. The apparatus of claim 9, wherein said first predetermined spacing has a mean of 0.070" with a standard deviation of 0.0017".

11. The apparatus of claim 9, wherein said second predetermined spacing ranges from 0.060" to 0.070".

12. The apparatus of claim 11, wherein said second predetermined spacing has a mean of 0.070" with a standard deviation of 0.0017".

* * * * *